United States Patent [19]

Irby

[11] 4,367,849

[45] Jan. 11, 1983

[54] PNEUMATIC TRANSFER MECHANISM FOR FORMING YARN TAIL ENDS

[75] Inventor: Enek E. Irby, Altavista, Va.

[73] Assignee: Burlington Industries, Inc., Greensboro, N.C.

[21] Appl. No.: 244,592

[22] Filed: Mar. 17, 1981

[51] Int. Cl.[3] ..... B65H 54/02; B65H 54/20

[52] U.S. Cl. ..... 242/18 PW; 242/35.5 R

[58] Field of Search ..... 242/18 PW, 18 R, 35.5 R

[56] References Cited

U.S. PATENT DOCUMENTS

| | | | |
|---|---|---|---|
| 3,814,339 | 6/1974 | Hudson | 242/18 PW |
| 3,814,341 | 6/1974 | Dickson et al. | 242/18 PW X |
| 3,880,371 | 4/1975 | Landenberger et al. | 242/18 PW X |
| 3,982,707 | 9/1976 | Saleeby | 242/18 PW |

FOREIGN PATENT DOCUMENTS

| | | | |
|---|---|---|---|
| 958394 | 11/1974 | Canada | 242/18 PW |

*Primary Examiner*—Stanley N. Gilreath

*Attorney, Agent, or Firm*—Cushman, Darby & Cushman

[57] ABSTRACT

A transfer mechanism for use with a drive cylinder which operates a piston and drive rod which in turn moves a shaped rod from a first to a second position in a fixed plane. Upon actuation of the cylinder the piston retracts causing the shaped rod to engage the yarns and direct the yarns into the paths of reciprocating guides. Once in the reciprocating guides, the yarn packages are formed.

5 Claims, 3 Drawing Figures

PNEUMATIC TRANSFER MECHANISM FOR FORMING YARN TAIL ENDS

BACKGROUND OF THE INVENTION

There exists in the textile industry a number of devices which are used to form yarn take-up packages on winding tubes. Several of these winders are designed so that multiple yarn packages can be formed simultaneously while mounted on the same spindle. One such winder is a Leesona 959 winder with a two cop take-up. It is at times desirable to form the yarn packages so that one end of yarn wound on the package is free from the main body of the wound yarn. A free end of this type is commonly referred to as a yarn tail and it allows the user of the yarn package to operate continuously in that, the yarn tail of one package can be tied to the lead end of another package to provide for an uninterrupted supply of yarn.

To facilitate the formation of yarn tails which are separate from the main body of the yarn package, a number of different devices have been developed including the apparatus disclosed in U.S. Pat. No. 3,814,339. The apparatus disclosed in that patent while providing for the formation of yarn tails on dual wound packages, has several drawbacks associated with its design and operation. Primarily, the problems with this apparatus relate to the rather complex and slow operation which it employs in transferring the yarn strands from their positions in forming the transfer tails to their positions used in forming the main body of the yarn package. The difficulty lies in directing the yarn strands from a centrally located guide to the two reciprocating guides associated with the winding tubes and which form, by their reciprocating movement, the main bodies of the yarn packages.

The prior art apparatus disclosed in U.S. Pat. No. 3,814,339 has a centrally located guide which has a holder positioned therein to retain the yarn strands while forming the yarn tails. The holder is maintained in place by an electromagnet. Upon reaching the required length for the yarn tails, the operator must deactivate an electromagnet which in turn releases the holder. The holder then under the influence of gravity falls away from the guide, spreading the two yarns and directing them to the reciprocating guides used to form the take-up packages.

Thus, this prior art device has several disadvantages, in that, the mechanism is complex and the time required to transfer the yarn strands from the central guide to the two reciprocating guides is relatively slow thus causing yarn waste.

SUMMARY OF THE INVENTION

The apparatus of the present invention is designed to overcome these disadvantages. One objective of the present invention is to have an apparatus which is simple in operation and which has fewer mechanical steps in its sequence of operation than the apparatus disclosed in U.S. Pat. No. 3,814,339.

Another object of the present invention is to eliminate the need for the electromagnet and employ instead an actuating means which operates in a more direct and efficient manner.

The present invention does accomplish those objectives, as well as others, by utilizing its unique and novel construction. In accordance with this invention, dual yarn take-up packages with yarn tails separate and apart from the main body of the package can be efficiently and economically formed on a winder such as the Leesona 959 winder. The winding tubes are placed in an abutting relationship on a rotatable spindle. The strands of yarn are guided to, and attached to, the abutting ends of the tubes through a centrally positioned and fixed guide. The positioning of the yarn strands in the guide is maintained by the normal tension of the yarn strands created by feeding the strands to the abutting ends of the tubes and attaching them thereto. The spindle is then set in motion and after the desired length for the yarn tails is obtained, usually about five yards the transfer mechanism of the present invention is actuated displacing the yarn strands from the fixed guide into the reciprocating guides which then by their movement form the main bodies of the yarn take-up packages.

The transfer mechanism is comprised of a shaped rod attached to a piston which is pneumatically operated. In its initial or start-up position, the piston is fully extended thereby placing the shaped rod forward of, and not engaged with the yarn strands running through the central guide. After the desired length of the yarn tail is wound on the abutting ends of the yarn packages, the piston is pneumatically actuated and achieves its retracted position. As the piston is being retracted the shaped rod is drawn into contact with the yarn strands held in the fixed guide and displaces the two strands from that fixed guide to a position where they will fall into the path of the reciprocating guides and become engaged by the reciprocating guides. The main bodies of the yarn take-up packages are then formed by the lateral movement of the reciprocating guides.

BRIEF DESCRIPTION OF THE DRAWINGS

By way of the example the invention will be illustrated by reference to drawings which are directed to the structure of the apparatus of the present invention.

DETAILED DESCRIPTION OF THE DRAWINGS

Figure 1:
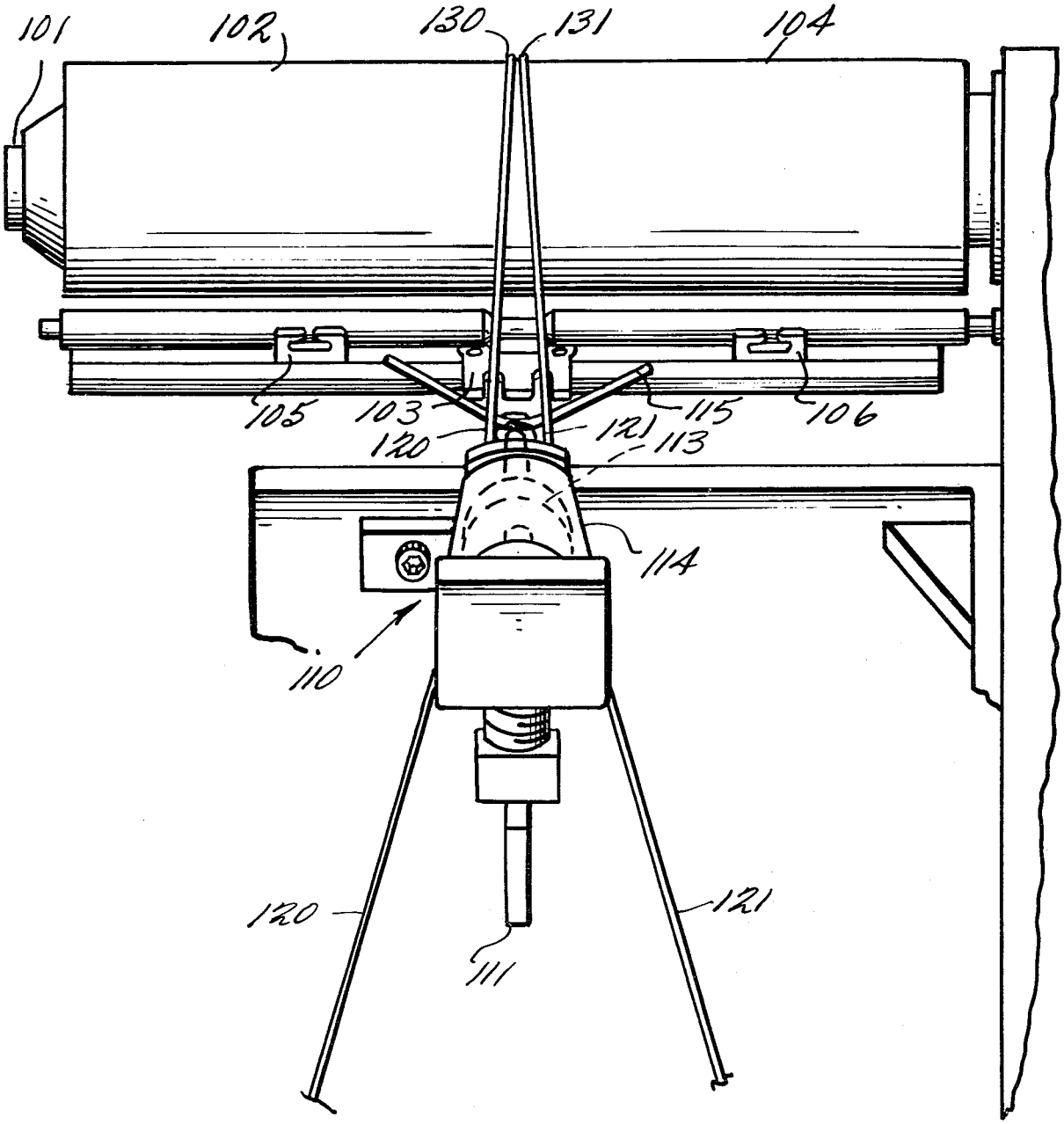
FIG. 1 is a diagrammatic illustration of the transfer mechanism in the initial position.
Figure 2:
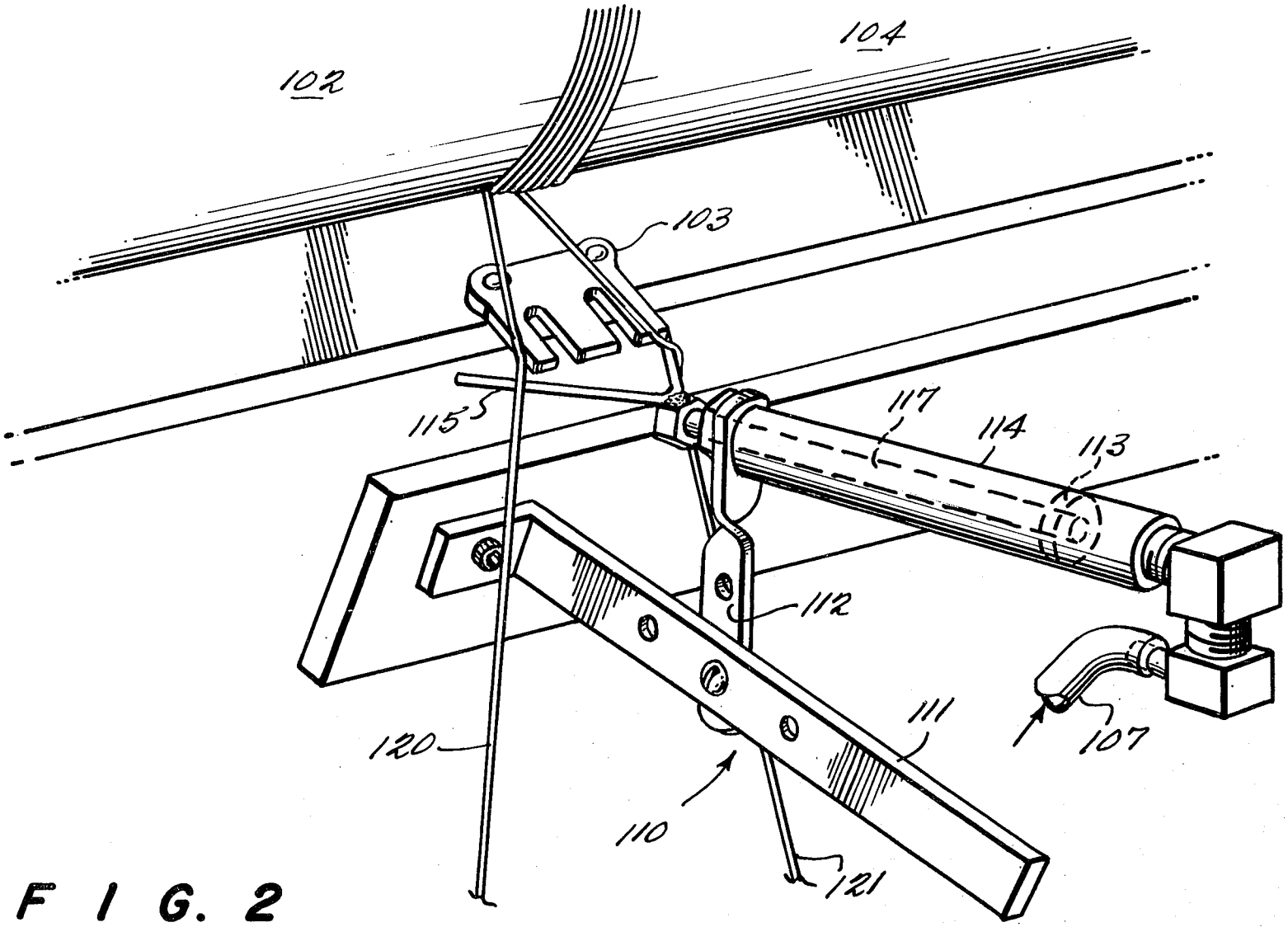
FIG. 2 is a diagrammatic illustration of the transfer mechanism after actuation of the pneumatic means with the strands being engaged by the shaped rod.
Figure 3:
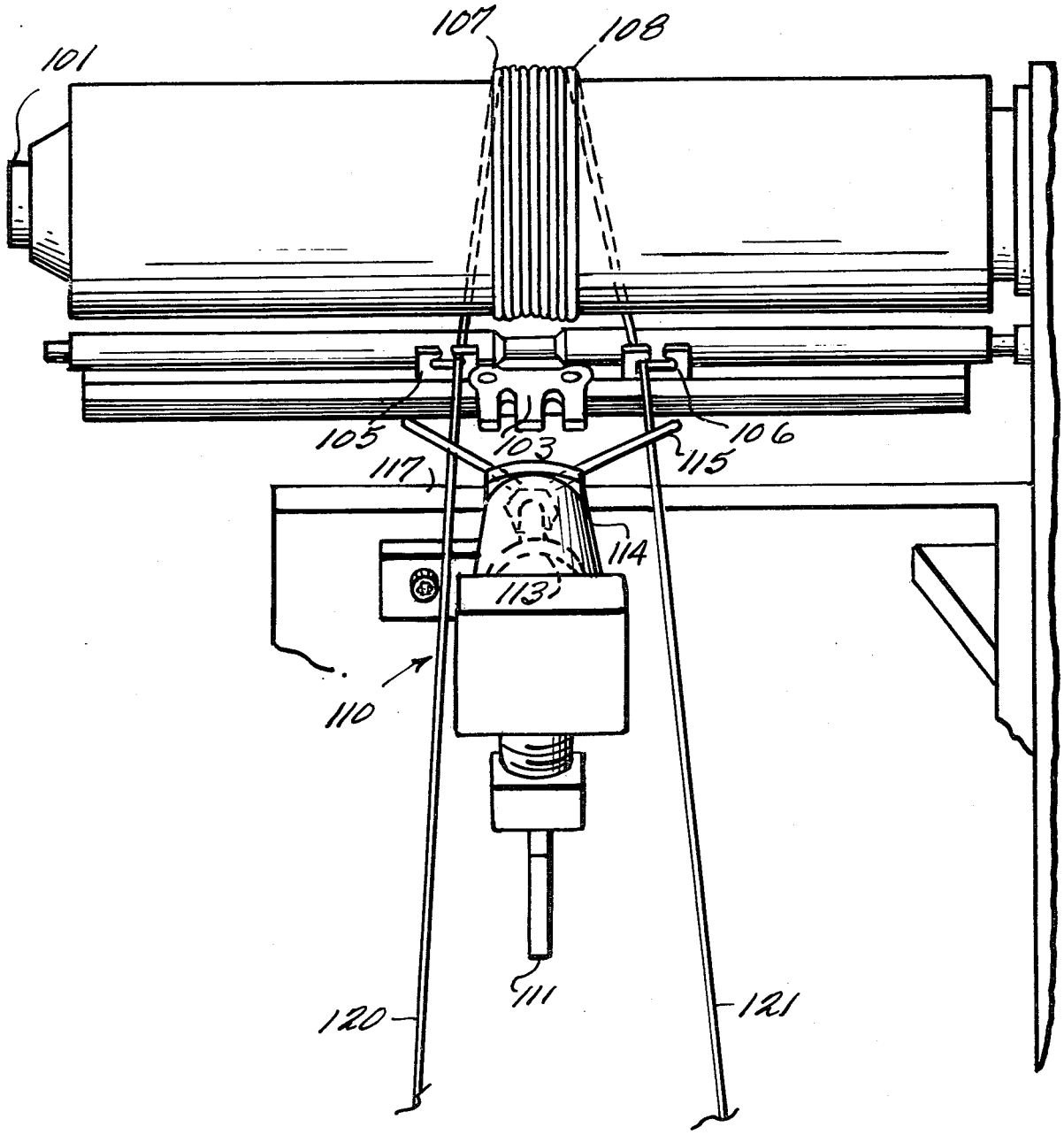
FIG. 3 is a diagrammatic illustration of the transfer mechanism in its final position with the strands in the reciprocating guide means of the winder.

FIGS. 1, 2 and 3 are all diagrammatic illustrations of the transfer mechanism and show its operation in the same sequence as if in actual operation.

The winder comprises a conventional rotatable spindle 101 on which are positioned two winding tubes 102 and 104 in an abutting arrangement. The spindle is set in rotation by a motor (not illustrated). As shown in FIG. 1, the yarn strands 120 and 121 are fed from a source (not illustrated) to a fixed guide 103 positioned centrally of the winder. The rotatable spindle and the source of the yarn strands are conventional and therefore no further descriptions of these are needed for a full disclosure. The yarn strands 120 and 121 are held in the guide 103 by the normal tension in the yarn created by the feeding of yarn strands from their source and attaching them to the abutting ends of the tubes. From the fixed guide 103 the yarn strands 120 and 121 are fed to and attached to the two winding tubes 102 and 104 at the abutting ends of the tubes.

The transfer mechanism 110 is mounted on the winder by a bracket 111 and strut 112. The transfer mechanism 110 is comprised of piston 113 which is actuated by a conventional hydraulic or pneumatic cylinder 114. Piston 113 actuates a drive rod 117 and a shaped rod 115 secured by welding or any other convenient means to the exterior end of drive rod 117. The cylinder 114 is connected with a source of plant air or hydraulic fluid via conduit 107 shown in FIG. 2. (not illustrated).

When the winder is started, the spindle 101 begins rotating which in turn rotates the winding tubes 102 and 104.

In the initial or start-up position, shown by FIG. 1, the piston 113 is extended thereby placing the shaped rod 115 forward of and not engaged with the two yarn strands 120 and 121. The yarn strands 120 and 121 maintain their position in the fixed guide 103 by the normal tension in the yarn strands and commence forming the tail ends 130 and 131 when the spindle begins rotating. Once adequate tail ends have been formed, for example five yards, the cylinder 114 is actuated, the piston 113 begins to retract and the yarn strands 120 and 121 are engaged by the shaped rod 115. In FIG. 2, the yarns have been contacted by the shaped rod 115 and have been displaced from the fixed guide 103. As the piston 113 continues to retract, the yarn strands 120 and 121 are spread further apart and move along the shaped rod 115 until they are in position to be engaged by the reciprocating guides 105 and 106.

In FIG. 3, the piston 113 is in its final or fully retracted position and the shaped rod 115 is no longer in any contact with the yarn strands 120 and 121. Instead the yarn strands 120 and 121 are positioned in the reciprocating guides 105 and 106 and the main bodies of the take-up packages 107 and 108 are being wound.

The shaped rod 115 as illustrated is in a "V" shape but, of course, any other shape such as a crescent or a "U" shape would also suffice as long as the yarn strands 120 and 121 are displaced from the fixed guide 103 and placed in position to fall in the path of the reciprocating guides 105 and 106. Similarly, the shaped rod as illustrated is constructed of $\frac{1}{8}''$ diameter stainless steel stock but virtually any material would be suitable.

The pneumatic means illustrated is a $\frac{1}{2}''$ pneumatic cylinder but again any suitable pneumatic device which operates a piston can be employed.

It is to be understood that the detailed description of the invention is provided for the sake of explanation and is illustrative of the invention. Various modifications and substitutions may be made without departing from the spirit and scope of the invention as set forth in the following claims which are to be given their broadest interpretation.

What is claimed is:

1. An apparatus for simultaneously winding yarn on multiple winding tubes comprising:

(a) means for rotatably mounting at least two abutting winding tubes, (b) means for rotating said winding tubes, (c) means for feeding at least one yarn strand to each of said winding tubes, (d) fixed yarn holding means for holding the yarn strands adjacent the abutting ends of said winding tubes, (e) reciprocating guide means associated with said mounting means for moving the yarn strands back and forth across said winding tubes to form yarn packages, said reciprocating guide means located between said winding tubes and said yarn holding means, (f) and movable transfer means comprising, a rod having two free ends bent at about its midpoint so that each end lies closer to said reciprocating guide means than its midpoint, and drive means for moving said rod in a fixed plane from a first position to a second position whereby in said first position said rod is located between said yarn holding means and said winding tubes and in said second position said yarn holding means is located between said winding tubes and said rod, and wherein during the course of movement from said first to said second position each of said free ends of said rod engages at least one yarn strand and disengages said strand from said yarn holding means whereby said strands are moved away from each other and are directed into the paths of said reciprocating guide means.

2. Apparatus of claim 1, wherein said rod has a substantially V shape and is positioned so that the opening extends toward said reciprocating guide means.

3. Apparatus of claim 2, wherein said rod is positioned in a plane spaced below said yarn holding means.

4. Apparatus of claim 3, wherein said drive means comprises a drive cylinder having a piston and drive rod attached thereto, said transfer means being secured to the end of said drive rod.

5. Apparatus of claim 1 wherein said fixed yarn holding means comprises at least one slot opening in a direction away from said winding tubes and said reciprocating guide means.

* * * * *